US011993924B2

(12) United States Patent
Neumann

(10) Patent No.: US 11,993,924 B2
(45) Date of Patent: May 28, 2024

(54) COLLECTING UNIT FOR COLLECTING A SUBSTANCE AND METHOD FOR ASSEMBLING THE COLLECTING UNIT

(71) Applicant: Alexander Allen Neumann, Holladay, UT (US)

(72) Inventor: Alexander Allen Neumann, Holladay, UT (US)

(73) Assignee: Alexander Allen Neumann, Holladay, UT (US)

( * ) Notice: Subject to any disclaimer, the term of this patent is extended or adjusted under 35 U.S.C. 154(b) by 293 days.

(21) Appl. No.: 17/590,676

(22) Filed: Feb. 1, 2022

(65) Prior Publication Data

US 2023/0272603 A1 Aug. 31, 2023

(51) Int. Cl.
*E03B 3/02* (2006.01)

(52) U.S. Cl.
CPC ..... *E03B 3/02* (2013.01)

(58) Field of Classification Search
None
See application file for complete search history.

(56) References Cited

U.S. PATENT DOCUMENTS 5,133,167 A * 7/1992 Drew ..... E04B 9/0478 52/506.08
9,228,326 B1 * 1/2016 Campbell ..... E03B 3/02
9,714,521 B1 * 7/2017 Aloumanis ..... E04H 15/32
10,190,292 B1 * 1/2019 Shackelford ..... E03B 3/03
10,426,236 B1 * 10/2019 Huckvale ..... A45B 25/18
11,096,458 B1 * 8/2021 Volin ..... B60K 8/00
11,399,603 B1 * 8/2022 Volin ..... A01D 46/243
2005/0133090 A1 * 6/2005 Couturier ..... E03B 3/02 137/236.1
2005/0252093 A1 * 11/2005 Degarie ..... A01C 3/028 52/3
2009/0212051 A1 * 8/2009 Liu ..... E03B 3/03 206/457
2010/0235979 A1 * 9/2010 Pesta ..... E04H 4/106 4/499
2012/0017996 A1 * 1/2012 Wenger ..... E03B 3/03 137/1
2014/0352842 A1 * 12/2014 McEvilly ..... E04H 15/04 141/69

* cited by examiner

*Primary Examiner* — Joshua K Ihezie
(74) *Attorney, Agent, or Firm* — Riyon Rae Harding

(57) ABSTRACT

A collecting unit and method for assembling the collecting unit are described in the present disclosure. The unit comprises a detachable frame structure and a collector arrangement. The frame structure comprises legs and a hub having holes on the surface of the hub. A first end of each of the legs is inserted in at least one hole of the hub. The arrangement comprises a collapsible plane having a first side for collecting a substance and a bottom side facing hub. Connecting assembly is provisioned for establishing a connection between each corner of the plane and the second end of the corresponding leg. The collector arrangement further comprises a geometry defining mechanism to define the geometry of the plane.

18 Claims, 18 Drawing Sheets

COLLECTING UNIT FOR COLLECTING A SUBSTANCE AND METHOD FOR ASSEMBLING THE COLLECTING UNIT

FIELD OF THE PRESENT DISCLOSURE

Embodiments of the present invention relate to devices and methods for collecting substances. In particular, embodiments of the present invention relate to a collecting unit for collecting substance and a method for assembling the collecting unit.

DESCRIPTION OF THE RELATED ART

Collecting substances like liquid or lightweight solids, from any kind of source, may be achieved using a collecting means. Conventionally, the collecting means may be designed based on an application. In certain geographical locations, water does not collect on the ground or flow readily, water may be a difficult resource to attain. For outdoor enthusiasts as well, any extended period of outdoor time may require a large amount of water. In such scenarios, one may have to bring the water or collect it at a given location. The water may be collected from an artificial source, or natural source, such as rainwater. For rainwater collection, conventionally, a tarpaulin may be placed in an open space to collect and hold the water. The collected water may be manually moved to a container, for immediate use. Some other conventional means for collecting liquid may implement mechanisms to directly channelize the water or liquid to a container. However, considering all conditions to support such a system or means in a way that does not collect debris and allows one to collect water in a controlled manner is not readily available. There may be a need for human intervention to carry out filtering to remove the debris. Similar arrangements may have to be made for collecting lightweight solids like berries or fruits from trees. Some of the collecting means may not be self-contained and may require outside construction resources to function. Such collecting means do not have the flexibility to be set up at any location. Also, the portability of such collecting means is another concern.

Therefore, there is a need for a device or unit that is passive, less complex, portable, easily installable, very adaptable, and efficient in collecting substance.

SUMMARY

A collecting unit for collecting substance and a method for assembling the collecting unit are described. The collecting unit comprises a collector arrangement that may be placed to collect substance and a detachable frame structure to hold the collector arrangement. The detachable frame structure comprises a hub having a plurality of holes on its surface. The detachable frame structure further comprises a plurality of legs, wherein the first end of each of said plurality of legs is inserted in one hole of the plurality of holes. At-least two legs of the plurality of legs are arranged to be lesser in length as compared to other legs of the plurality of legs. The collector arrangement comprises a collapsible arrangement having the first side for collecting the substance and the second side facing the hub. Further, the collector arrangement comprises a connecting assembly, a geometry defining mechanism, and a substance collecting and container holding mechanism. The connecting assembly is attached at each corner of the collapsible plane, for establishing a connection between each corner of the collapsible plane with the second end of the plurality of legs. The geometry defining mechanism establishes a connection between the center of the bottom side of the collapsible plane with the detachable frame structure. The geometry defining mechanism defines a preferred geometry of the collapsible plane.

In an embodiment, each leg from the plurality of legs comprises any or combination of two or more straight poles, an angled pole, and a connector tip. The two or more straight poles are connected using the angled pole to form the leg with the first end and the second end. The connector tip is accommodated at the second end of the leg and connects with a corner of the collapsible plane.

In an embodiment, the detachable frame structure further comprises a leg cord accommodated inside each leg from the plurality of legs. A first cord end of the leg cord is attached to the connector tip, and a second cord end of the leg cord is attached, within the hub, to a second cord end of a leg cord accommodated inside another leg oppositely inserted in the detachable frame structure.

In an embodiment, the detachable frame structure further comprises a securing mechanism to secure the plurality of legs firmly on the surface.

In an embodiment, the connecting assembly, at each corner of the collapsible plane, comprises a first looped ribbon attached on the collapsible plane at the corner, a grommet on the first looped ribbon. The second end of the corresponding leg is accommodated within the grommet.

In an embodiment, the geometry defining mechanism comprises a second looped ribbon and a pulling cord. The second looped ribbon is attached at the center of the bottom side of the collapsible plane. A first cord end of the pulling cord is attached to the second looped ribbon, and a second cord end of the pulling cord is attached to the detachable frame structure.

In an embodiment, the second cord end of the pulling cord is coupled with a hooking component to hook with one of the plurality of legs of the detachable frame structure.

In an embodiment, the collector arrangement further comprises a substance collecting and container holding mechanism attached at the second edge of the collapsible plane and is configured to accommodate the container and collect the substance in the container.

In an embodiment, the collecting and container holding mechanism comprises a control stitch and an egress. The control stitch is provisioned on the first edge to control the movement of the collected substance. The egress is formed on the top surface towards a first edge of the collapsible plane.

In embodiment, an the substance collecting and container holding mechanism further comprises a funnel structure attached to the bottom side, beneath the egress.

In an embodiment, the funnel structure comprises a fabric mesh and a wire mesh. The fabric mesh is in a cone shape, with the vertex side of the fabric mesh facing the container and the base side of the fabric mesh attached to the first edge. The wire mesh is placed on the base side of the fabric mesh.

In an embodiment, the substance collecting and container holding mechanism further comprises a container pouch fitted at the first edge to accommodate the container. The container pouch comprises a locking mechanism to hold the container within the container pouch.

The method for assembling the collecting unit for collecting the substance comprises assembling the detachable frame structure using the plurality of legs and the hub, connecting each corner of the collapsible plane with the detachable frame structure using the connecting assembly, and defining a geometry of the collapsible plane using the geometry defining mechanism, for collecting the substance.

Other features of embodiments of the present disclosure will be apparent from accompanying drawings and the detailed description that follows.

BRIEF DESCRIPTION OF THE DRAWINGS

In the figures, similar components and/or features may have the same reference label. Further, various components of the same type may be distinguished by following the reference label with a second label that distinguishes among the similar components. If only the first reference label is used in the specification, the description applies to any one of the similar components having the same first reference label irrespective of the second reference label.

Referring to the Figures.

DETAILED DESCRIPTION

Figure 1A:
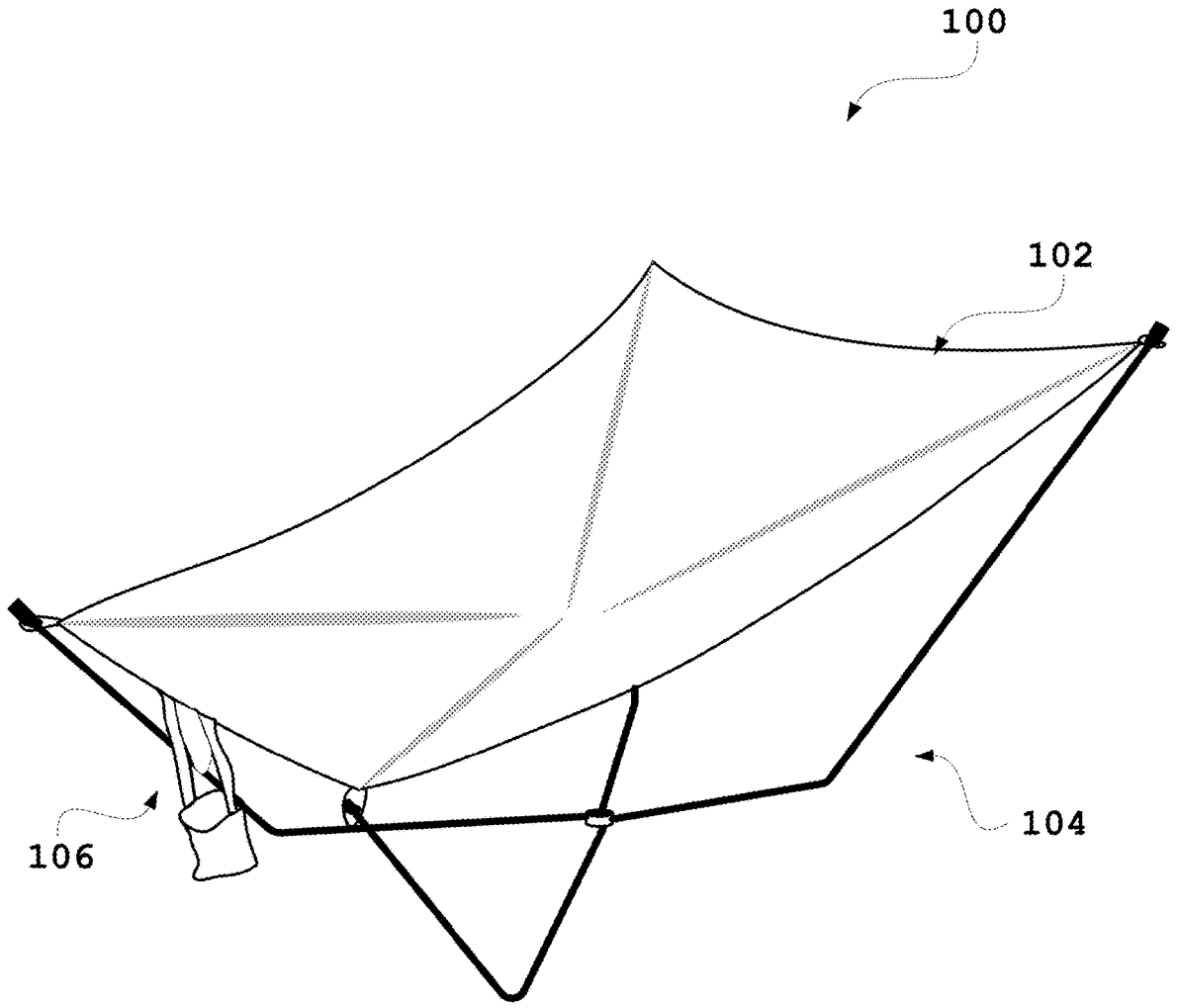
FIG. 1A shows a 45° view of a collecting unit, in accordance with an embodiment of the present disclosure.

The present disclosure relates to a collecting unit used for collecting substances. The proposed collecting unit is collapsible, modular in nature, and functions passively. The collecting unit may be placed outdoors or indoors to collect any kind of substance which may be liquid or lightweight solids.

The collecting unit comprises a detachable frame structure and a collector arrangement that is placed to collect the substance. The detachable frame structure comprises a plurality of legs and a hub having a plurality of holes on the surface of the hub. A first end of each of said plurality of legs is inserted in at least one hole from the plurality of holes. At-least two legs of the plurality of legs are lesser in length as compared to other legs of the plurality of legs Further, the collector arrangement comprises a collapsible plane. The collapsible plane comprises a first side for collecting the substance and a second side facing the hub. The collapsible plane is placed to be inclined by connecting corners of the first edge of the collapsible plane with the at least two legs of the plurality of legs. The collector arrangement also comprises a connecting assembly provisioned at corners of the collapsible plane, for establishing a connection between each corner of the collapsible plane with the second end of the plurality of legs.

The collector arrangement further comprises a geometry defining mechanism to establish a connection between the center of the bottom side of the collapsible plane with the detachable frame structure. The geometry defining mechanism defines the geometry of the collapsible plane.

The collector arrangement also comprises a substance collecting and container holding mechanism attached at the first edge of the collapsible plane. The substance collecting and container holding mechanism are configured to accommodate the container and collect the substance in the container.

The proposed collecting unit may be used by outdoor enthusiasts as a water source in places that may not have access to clean or reliable water, or in places that have regular rainfall that can be readily collected. Also, the proposed collecting unit may be used to collect lightweight solids. The collapsible and modular nature of the collecting unit allows a user to carry it with them and use it when required to collect the substance. The user may completely set up the collecting unit by just attaching the components together, without the need for additional support. Further, the self-contained nature of the collecting unit allows it to be set up in an area where there is no overhanging foliage. Rain can disrupt leaves, needles, sticks, branches, pollen, animal droppings, etc. in a tree. For water collection, if the collecting unit is set up under a tree, inevitably these elements will fall into the collecting unit. The collecting unit can be set up in areas where there is nothing but an open sky. In case the collected water includes debris, passive filtering of the liquid is provisioned to filter. The collecting unit is mounted to the ground with a fitting mechanism. This allows the collecting unit to be set up on most surfaces.

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form to avoid obscuring the concepts of the presently disclosed method and system.

Embodiments of the present invention include various steps, which will be described below. The steps may be performed by hardware components or may be embodied in machine-executable instructions, which may be used to cause a general-purpose or special-purpose processor programmed with the instructions to perform the steps.

The terms "connected" or "coupled" or "attached" and related terms are used in an operational sense and are not necessarily limited to a direct connection or coupling. Thus, for example, two devices may be coupled directly or via one or more intermediary media or devices. As another example, devices may be coupled in such a way that information can be passed therebetween, while not sharing any physical connection with one another. Based on the disclosure provided herein, one of ordinary skill in the art will appreciate a variety of ways in which connection or coupling exists in accordance with the aforementioned definition.

If the specification states a component feature "may," "can," "could," or "might" be included or have a characteristic, that particular component or feature is not required to be included or have the characteristic.

As used in the description herein and throughout the claims that follow, the meaning of "a," "an," and "the" includes plural reference unless the context dictates otherwise. Also, as used in the description herein, the meaning of "in" includes "in" and "on" unless the context dictates otherwise.

The phrases "in an embodiment," "according to one embodiment," "in a preferred embodiment," "in some embodiments," "in an alternate embodiment" and the like generally mean the particular feature, structure, or characteristic following the phrase is included in at least one embodiment of the present disclosure and may be included in more than one embodiment of the present disclosure. Importantly, such phrases do not necessarily refer to the same embodiment.

As used herein, a "target output" generally refers to various forms of data, information, services, applications, and/or hardware devices that may be accessed via a network (e.g., the Internet). Non-limiting examples of target output include web applications, cloud-based services, network devices, and/or associated applications (e.g., user interface applications), and network security devices and/or associated applications (e.g., user interface applications). Exemplary embodiments will now be described more fully hereinafter with reference to the accompanying drawings, in which exemplary embodiments are shown. This invention may, however, be embodied in many different forms and should not be construed as limited to the embodiments set forth herein. These embodiments are provided so that this invention will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating systems and methods embodying this invention. The functions of the various elements shown in the figures may be provided through the use of dedicated hardware as well as hardware capable of executing associated software. Similarly, stitches shown in the figures are conceptual only. Their function may be carried out through the operation of program logic, through dedicated logic, through the interaction of program control and dedicated logic, or even manually, the particular technique being selectable by the entity implementing this invention. Those of ordinary skill in the art further understand that the exemplary hardware, software, processes, methods, and/or operating systems described herein are for illustrative purposes and, thus, are not intended to be limited to any particular name.

Figure 1B:
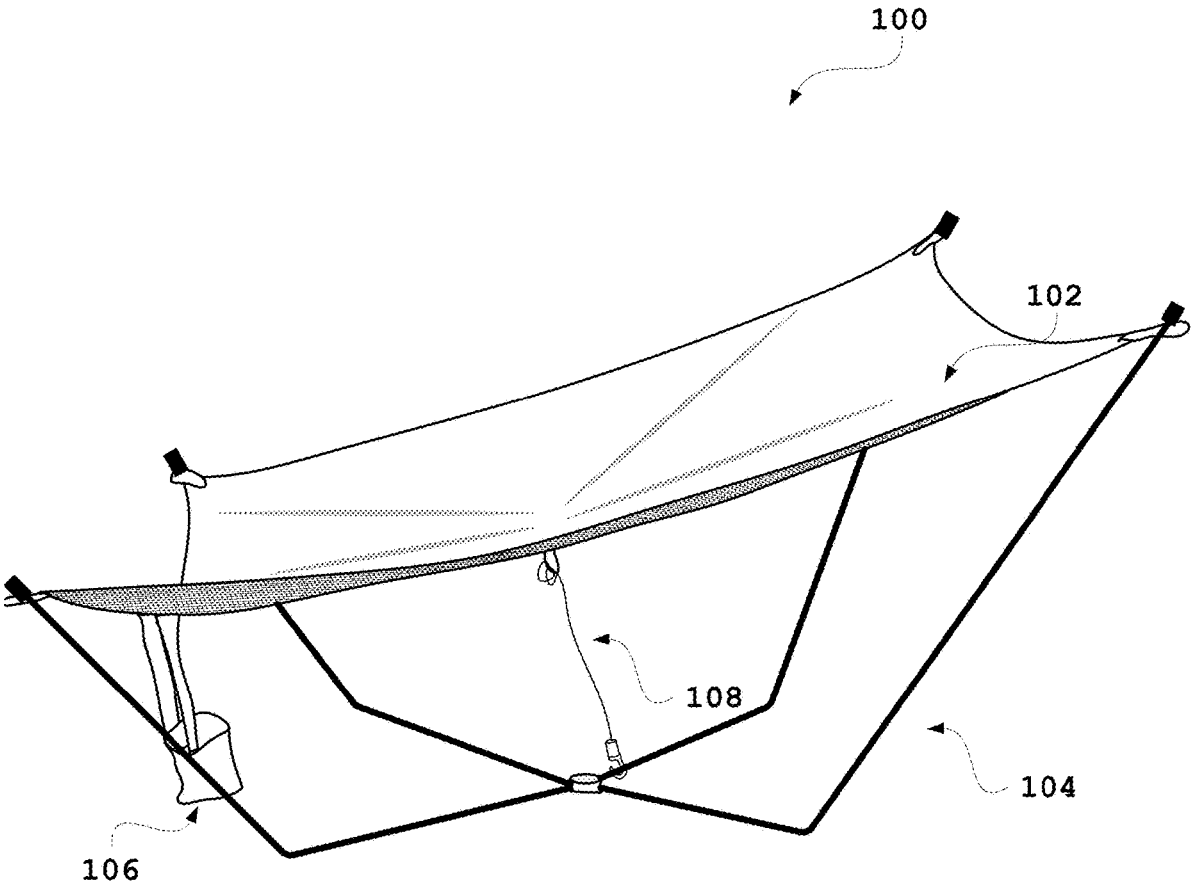
FIG. 1B shows a side view of a collecting unit, in accordance with an embodiment of the present disclosure.
Figure 1C:
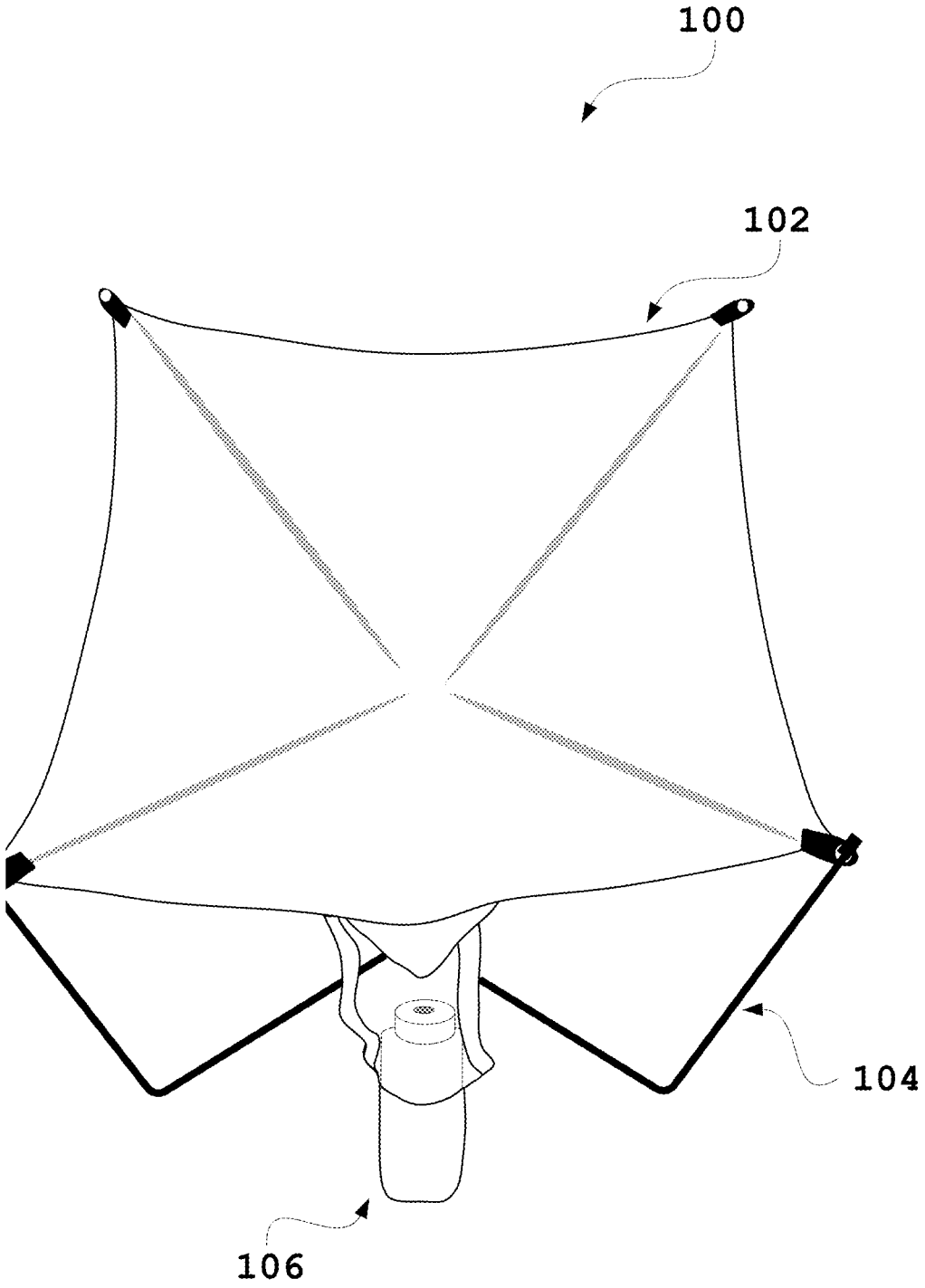
FIG. 1C shows a front view of a collecting unit, in accordance with an embodiment of the present disclosure.
Figure 1D:
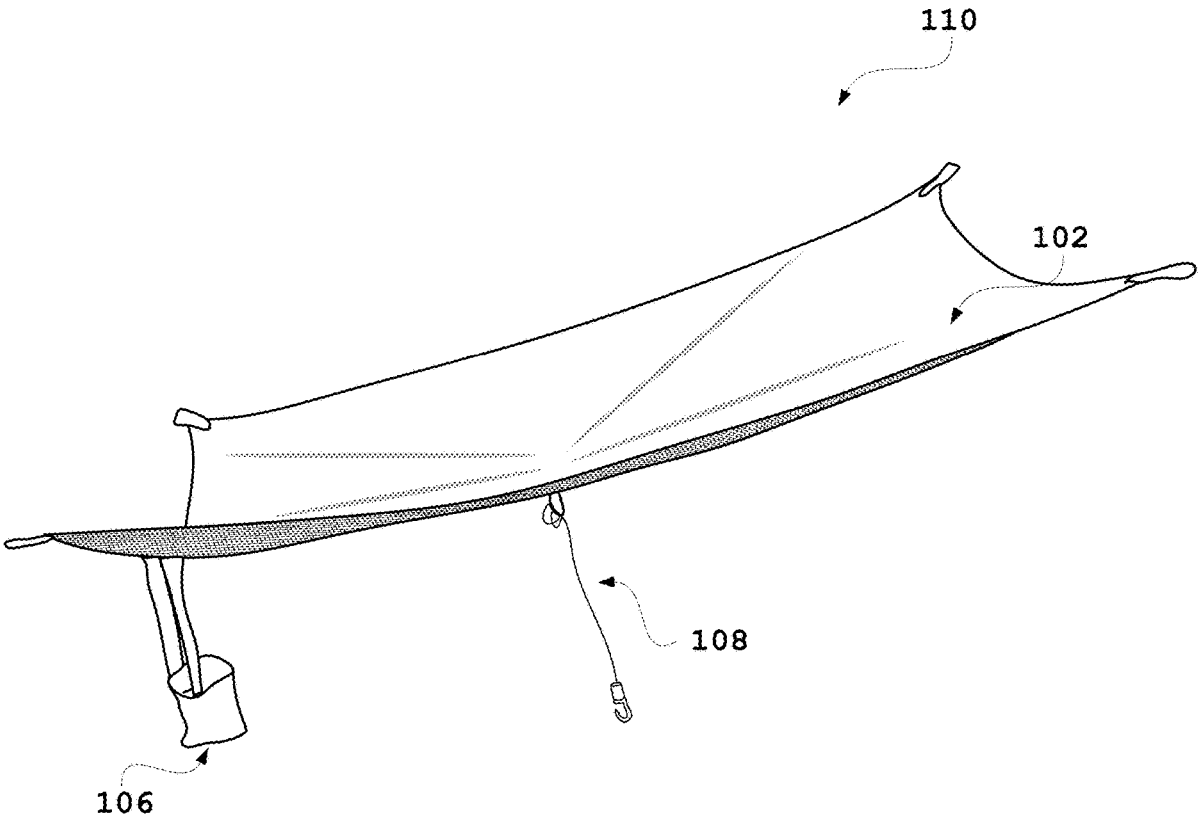
FIG. 1D shows an exemplary representation of collector arrangement of a collecting unit, in accordance with an embodiment of the present disclosure.

FIG. 1A shows a 45° view of a collecting unit 100, in accordance with an embodiment of the present disclosure. FIG. 1B shows a side view of the collecting unit 100, in accordance with an embodiment of the present disclosure. FIG. 1C shows a front view of the collecting unit 100, in accordance with an embodiment of the present disclosure. The illustrated views are exemplary views of the collecting unit 100. The collecting unit 100 is configured to collect substance. The substance may be liquid, like rainwater. The substance may be lightweight solids, like nuts, berries, and so on. In an embodiment, the collecting unit 100 may be placed outdoors in an open space to collect substance. The collecting unit 100 may be placed to collect any substance from any source. The collecting unit 100 mainly includes a detachable frame structure 104 and a collector arrangement 110. An exemplary representation of the collector arrangement 110 is shown in FIG. 1D.

The detachable frame structure 104 is designed to hold the collector arrangement 110 to collect the substance. The detachable frame structure 104 is a collapsible and multipart rigid structure. In an embodiment, multiple parts of the detachable frame structure 104 are connected and interlocked to form a rigid structure to hold the collector arrangement 110 in its shape. In an embodiment, the detachable frame structure 104 may be rigidly secured on a surface on which the collecting unit 100 is placed. In an alternate embodiment, the detachable frame structure 104 may be placed at a greater height from the surface, using supporting components such as poles or rods.

Figure 2A:
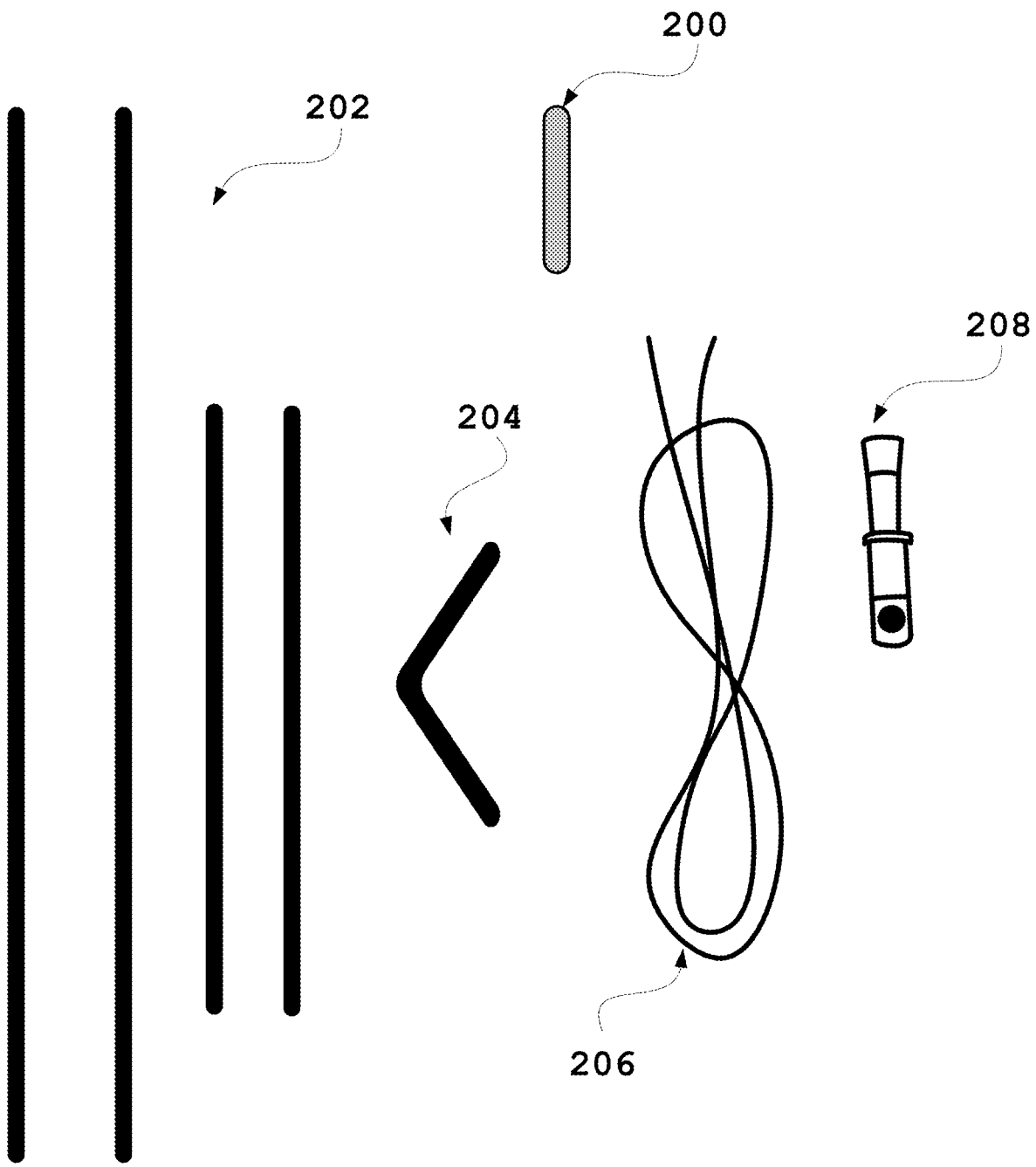
FIG. 2A shows an exemplary representation of components of a leg of the plurality of legs, in accordance with an embodiment of the present disclosure.
Figure 2B:
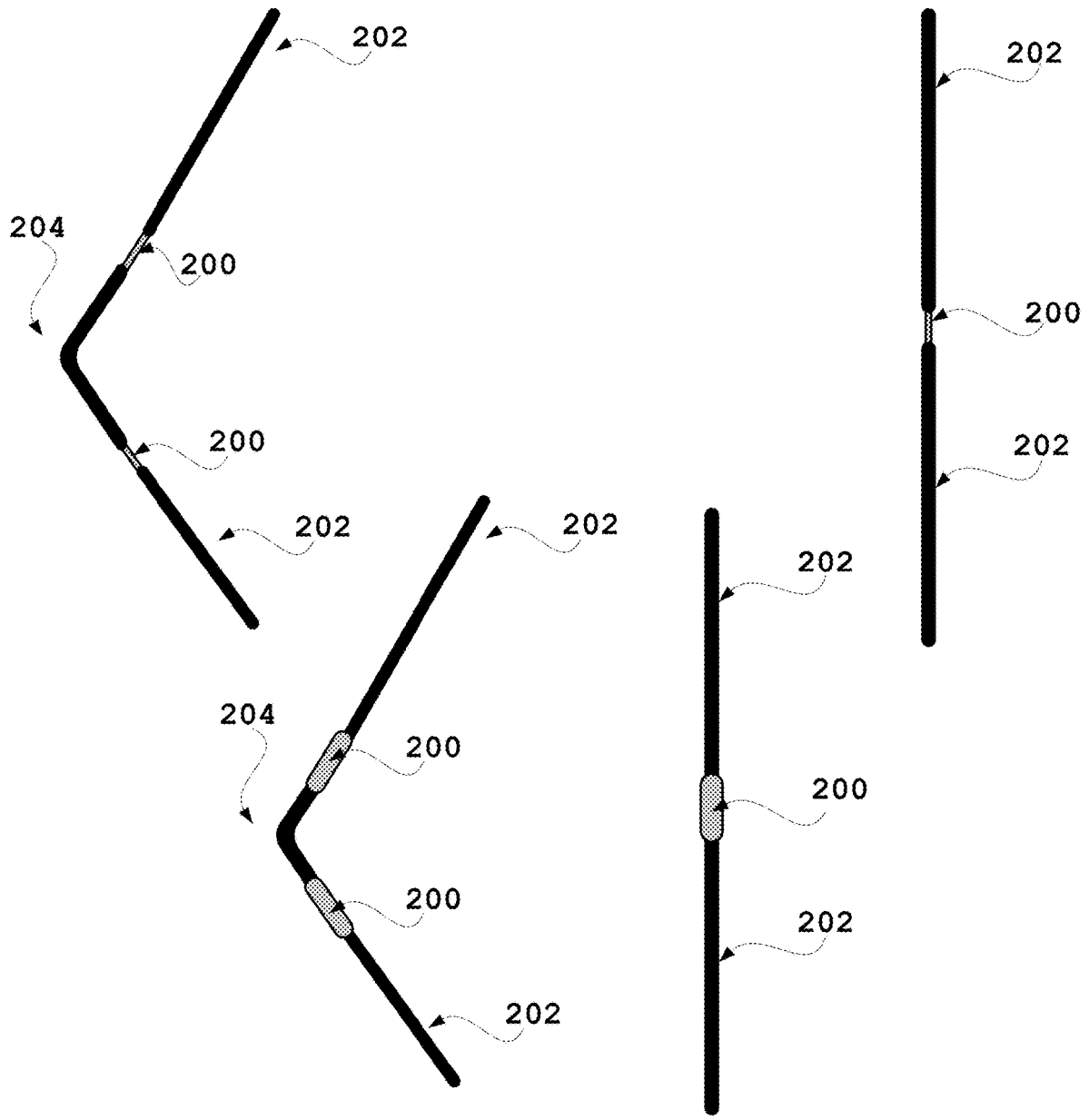
FIG. 2B shows exemplary representations of a leg, in accordance with an embodiment of the present disclosure.

As shown in the FIGURES, the detachable frame structure 104 includes a plurality of legs and a hub. FIG. 2A shows an exemplary representation of components of a leg from a plurality of legs, in accordance with an embodiment of the present disclosure. Each leg from the plurality of legs includes two or more straight poles 202, an angled pole 204, and a connector tip 208. In an embodiment, each leg further comprises an insert unit 200. In an embodiment, each leg further comprises a leg cord 206 which is accommodated inside the leg. FIG. 2B shows exemplary representations of a leg, in accordance with an embodiment of the present disclosure. In an embodiment, the two or more straight poles 202 and the angled pole 204 are connected using at least one insert unit 200 to form a first end and a second end of the leg. In an alternate embodiment, the plurality of legs may be straight legs protruding from the hub. In such embodiment, the two or more straight poles 202 may be connected using at least one insert unit 200 to form a leg, eliminating the angled pole 204. In an embodiment, each of the two or more straight poles 202 and the angled pole 204 may be hollow interlocking cylindrical segments. Such hollow interlocking cylindrical segments may be made of aluminum, fiberglass, or bamboo. Each of the two or more straight poles 202 and the angled pole 204 may be made of other materials known to a person skilled in the art. In an embodiment, the insert unit may be a hollow cylinder with ends having circumferential diameter lesser than the circumferential diameter of ends of the two or more straight poles 202 and the angled pole 204. In such case, the insert unit 200 is accommodated inside the two or more straight poles 202 and the angled pole 204 to establish a connection between the two or more straight poles 202 and the angled pole 204, to form a leg. In an alternate embodiment, the insert unit may have ends with a circumferential diameter greater than the circumferential diameter of ends of the two or more straight poles 202 and the angled pole 204. In such case, the two or more straight poles 202 and the angled pole 204 is accommodated inside the insert unit 200 to establish a connection between the two or more straight poles 202 and the angled pole 204, to form a leg.

Figure 2C:
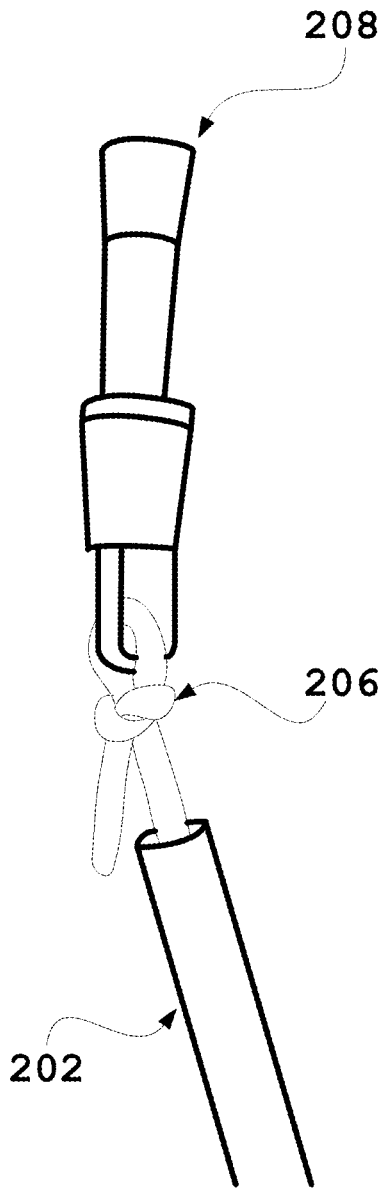
FIG. 2C shows an exemplary representation of connector tip accommodated at the second end of a leg, in accordance with an embodiment of the present disclosure.

The connector tip 208 is accommodated at the second end of the leg to connect with a respective corner of the collapsible plane 102. FIG. 2C shows an exemplary representation of the connector tip 208 accommodated at the second end of the leg, in accordance with an embodiment of the present disclosure. In an embodiment, as shown in FIG. 2C, the leg cord 206 is accommodated inside the leg. A similar leg cord may be accommodated within each of the plurality of legs. The first cord end of the leg cord 206 is attached to the connector tip 208, and the second cord end of the leg cord 206 is attached, within the hub, to the second cord end of the second cord accommodated inside the other leg placed opposite to the leg. Thus, legs amongst the plurality of legs, placed opposite to each other, are connected via respective cords, within the hub. A cord of each of the plurality of legs may be expandable along its axis. In an embodiment, the cord may be a shock cord. The length of the cords may be greater than the length of the corresponding leg. A designated length of the cord is provided to add internal support for the corresponding leg. In an embodiment, the leg cord 206 may be tied to the connector tip 208 at the first cord end and tied to the leg cord of the opposite leg at the second cord end. One or more other means of establishing a connection using the leg cord 206 may be implemented in the present disclosure.

Figure 2D:
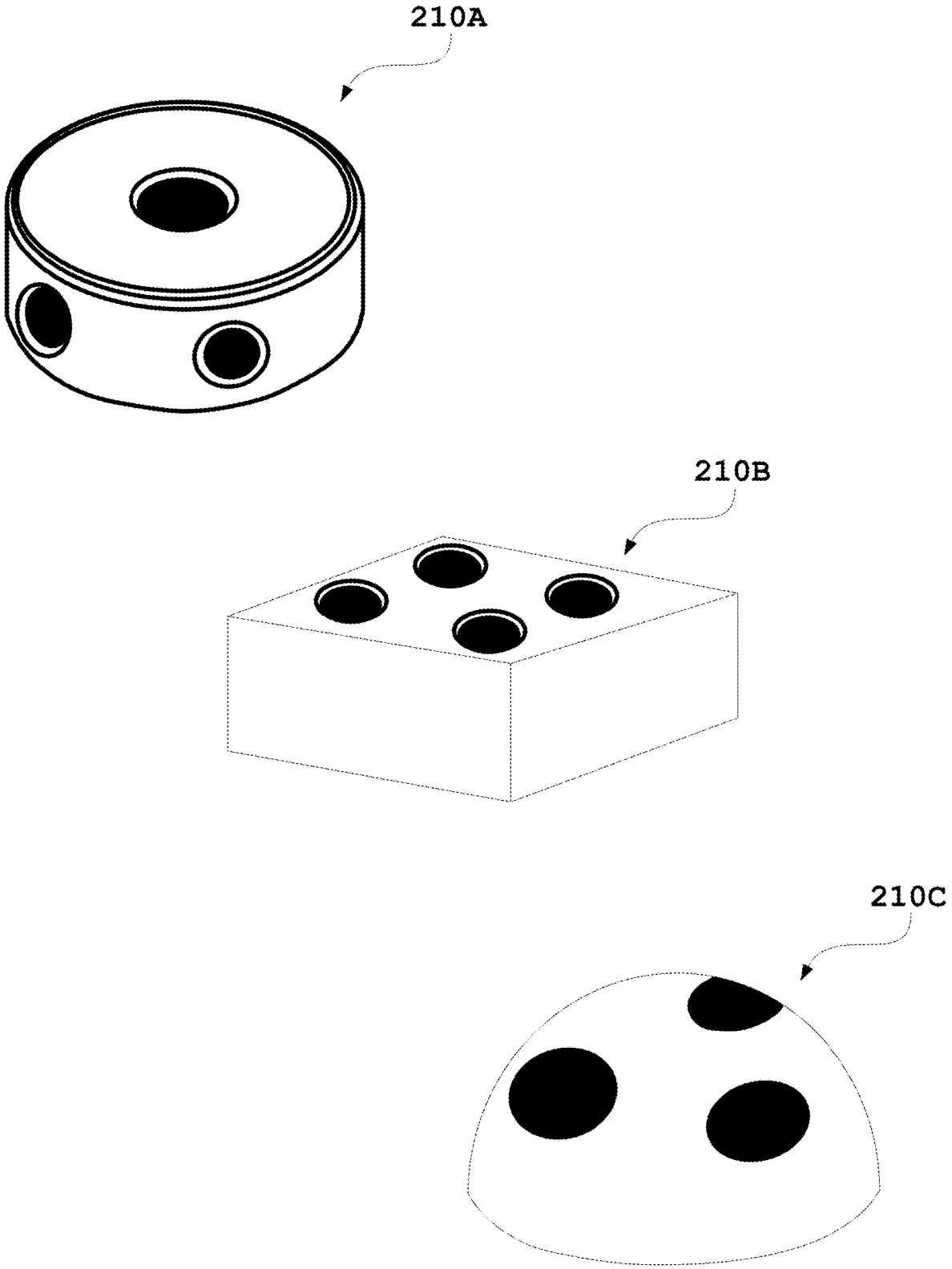
FIG. 2D shows exemplary representations of a hub, in accordance with an embodiment of the present disclosure.
Figure 2E:
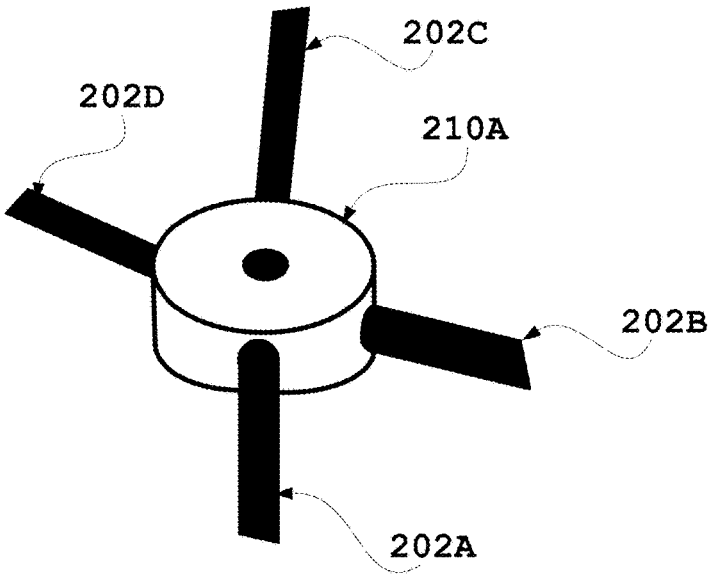
FIG. 2E shows exemplary representations of hub accommodating a plurality of legs, in accordance with an embodiment of the present disclosure.
Figure 2E:
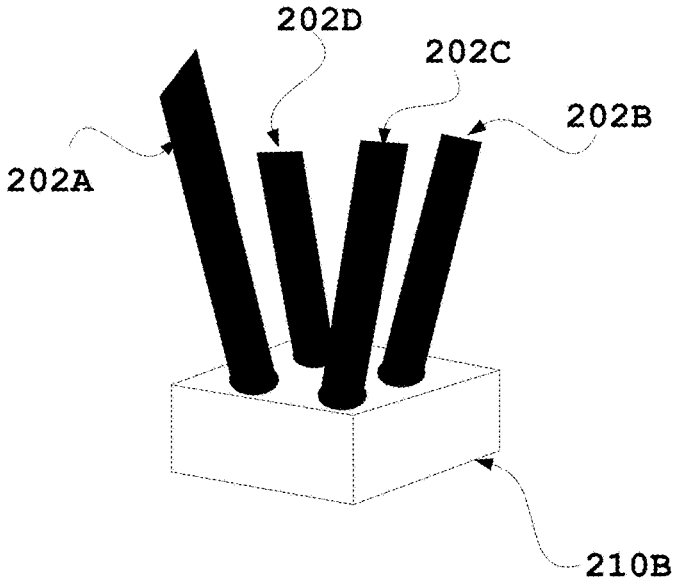
Figure 2F:
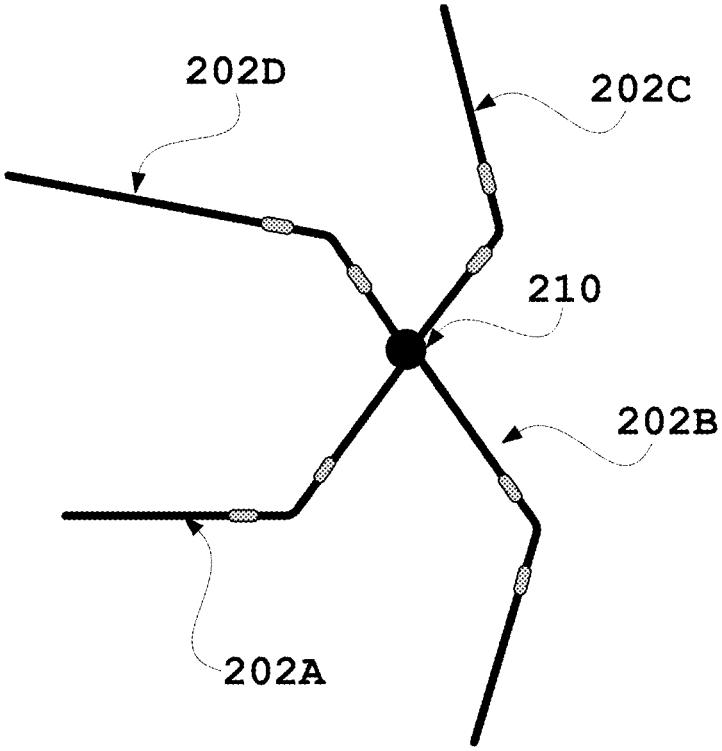
FIG. 2F shows exemplary representations of the detachable frame structure, in accordance with an embodiment of the present disclosure.
Figure 2F:
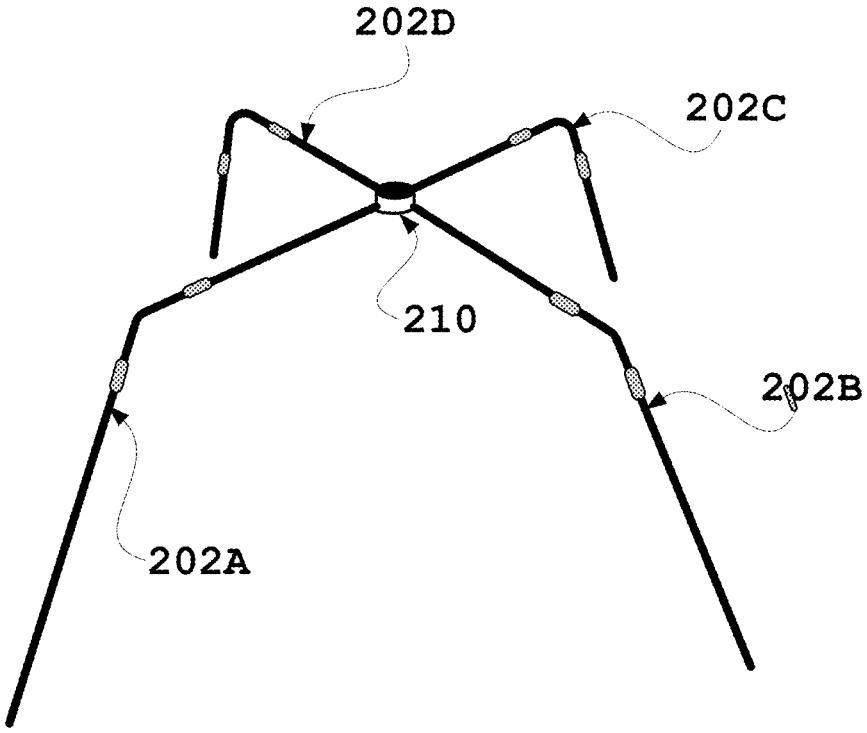

FIG. 2D shows exemplary representations of hub 210A, 210B, and 210C (also referred to as hub 210), in accordance with an embodiment of the present disclosure. FIG. 2D shows isometric views of hub 210. The hub 210 may be hollow and solid. As shown in the figure, hub 210 may be cylindrical. In an alternate embodiment, the hub 210 may be a cuboid, conical, hemisphere so on. Hub 210 comprises a plurality of holes on the surface of hub 210. In an embodiment, the hub 210 is designed to interlock two legs. In an embodiment, when the hub 210 is cylindrical, the plurality of holes may be on a curved surface or flat surface of the hub 210. In an embodiment, when the hub 210 is in cuboid shape, the plurality of holes may be on the top surface or side surface of the hub 210. In an embodiment, when the hub 210 is in hemisphere shape, the plurality of holes may be on the curved surface of the hub 210. The first end of each of said plurality of legs is inserted inside at least one hole from the plurality of holes. FIG. 2E shows an exemplary representation of the hub 210 accommodating plurality of legs 202A, 202B, 202C, and 202D, in accordance with an embodiment of the present disclosure. In an embodiment, the plurality of legs may be inserted to be parallel to the surface. In an alternate embodiment, the plurality of legs may be inserted to be angled with the surface. In an exemplary embodiment, straight pole associated with the first end of each of the plurality of legs 202A, 202B, 202C, and 202D may be parallel to the surface and straight pole associated with the second end of each of said plurality of legs 202A, 202B, 202C, and 202D may be aligned to be angled with the surface, as shown in FIG. 2F. In an alternate embodiment, the straight pole associated with the first end and the second end of each of the plurality of legs 202A, 202B, 202C, and 202D may be aligned to be angled with the surface. The plurality of legs may be aligned in other ways, known to a person skilled in the art, to support the collector arrangement 110.

In an embodiment, the hub 210 may be made of plastic or metal. In an embodiment, the diameter of the plurality of holes may be designed to accept the outside diameter of the corresponding leg. In an embodiment, locations of the plurality of holes on the surface of the hub 210 may be determined by an angle required to set the plurality of legs 202A, 202B, 202C, and 202D. Overall, the detachable frame structure 104 creates a 3D structure with the hub 210 connecting the plurality of legs 202A, 202B, 202C, and 202D, with an aim of creating a mounting location for the collector arrangement 110. At-least two legs of the plurality of legs are lesser in length as compared to other legs of the plurality of legs In an embodiment, the detachable frame structure 104 further includes a securing mechanism to secure and fix each of the plurality of legs 202A, 202B, 202C, and 202D firmly on the surface (not shown in figures). In an embodiment where the straight pole associated with the first end of the leg is parallel to the surface, to keep the collecting unit 100 stationed while in use, multiple stakes are used to secure the collecting unit 100 to the ground. At the farthest location from hub 210, while still being in contact with the surface, a stake is placed over the leg to secure it to the surface. In an alternate embodiment, each of the two or more straight poles 202, which are inserted inside the hub 210, may include a provision to secure such poles to the surface. In an embodiment, hub 210 may be associated with the securing mechanism. In an embodiment where the plurality of legs is aligned to be angled with the surface, the securing mechanism may be associated with each of the legs to aid fixture to the surface. One or more techniques, known to a person skilled in the art, may be implemented as the securing mechanism to achieve such fixture.

The collector arrangement 110 comprises the collapsible plane 102, a connecting assembly, a geometry defining mechanism 108, and collecting and container holding mechanism 106. In an embodiment, the collapsible plane 102 may be a surface with three or more edges. The exemplary embodiments in the Figures illustrate the collapsible plane 102 to be a trapezoid with four edges. In an alternate embodiment, the collapsible plane 102 may be any shape with more than three edges. The collapsible plane 102 may be a collapsible and foldable fabric mesh. In an embodiment, the collapsible plane 102 may be a single sheet of fabric with additional items sewn on the perimeter corners and multiple internal locations. The first side of the collapsible plane 102 is placed to collect the substance and the second side of the collapsible plane 102 is placed to face the hub 210. The collapsible plane 102 is inclined with a first edge at a lower distance from the surface by connecting the corners of the first edge with at least two legs with a lesser length. Such inclination may aid in the movement of substance to the container. In an embodiment, the collapsible plane 102 may be inclined at a predefined angle. The predefined angle may be selected such that the collected substance moves towards the first edge of the collapsible plane 102. In an embodiment, the predefined angle may be selected to be any angle that is greater than 00 and lesser than 90. In an embodiment, the collapsible plane 102 may be made of a material with properties of low friction to enable easy movement of the collected substance. In an embodiment, for collecting a substance that may be in liquid form, the collapsible plane 102 may be made of a material that is water-resistant, waterproof, or hydrophobic. In an embodiment, the material of the collapsible plane 102 may be selected to be flexible to enable to define a geometry of the collapsible plane 102. For example, the collapsible plane 102 may be made of polyester, nylon, oilcloth, silk, spandex, and so on. One or more other materials, which inherits the properties required to be implemented in the collecting unit 100, may be used as the collapsible plane 102.

Figure 3A:
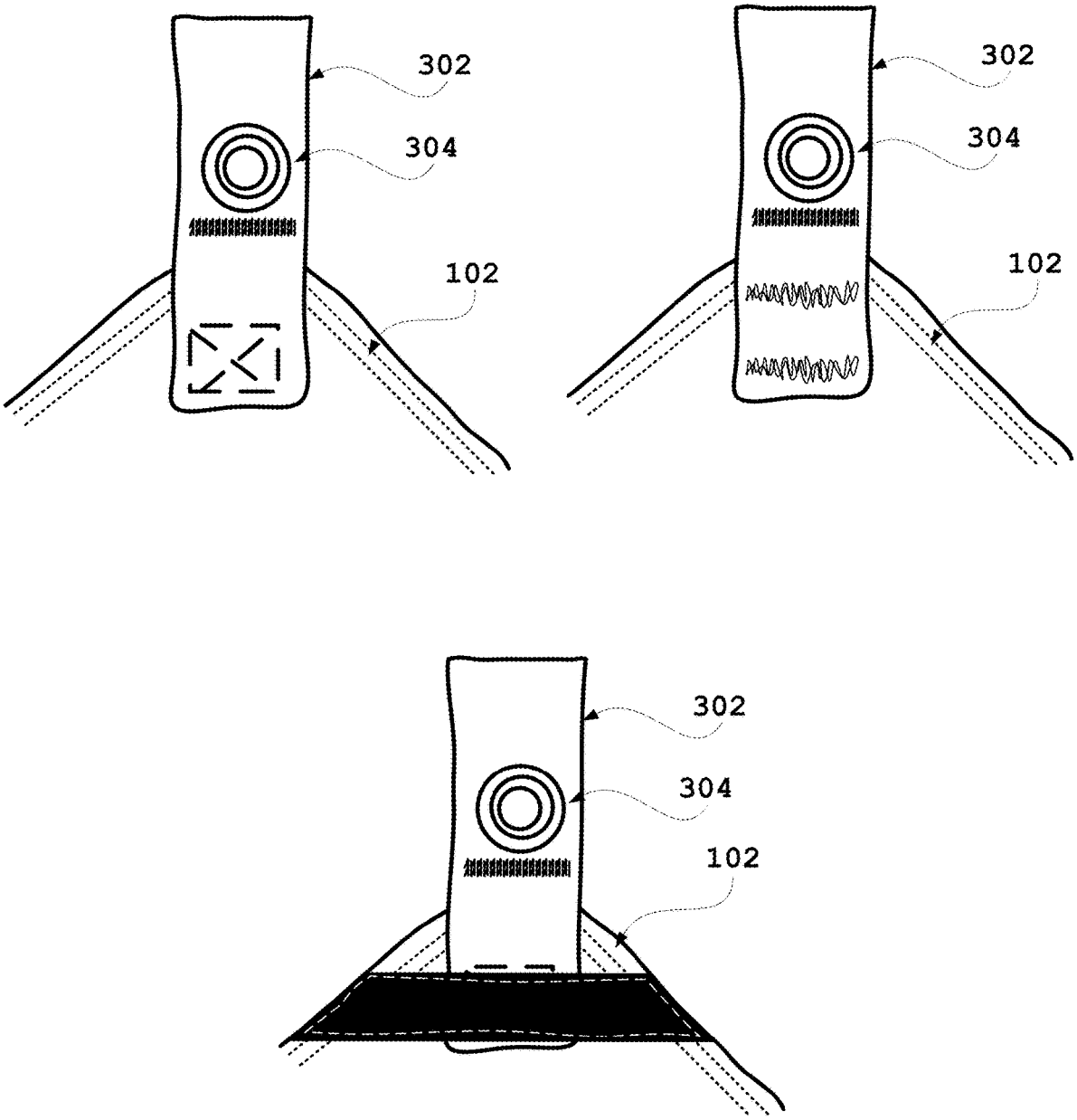
FIGS. 3A and 3B show exemplary representations of connecting assembly, in accordance with an embodiment of the present disclosure.
Figure 3B:
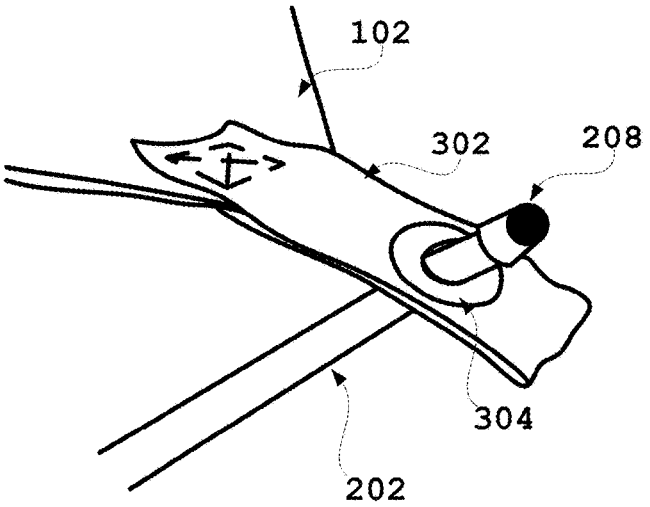
Figure 3B:
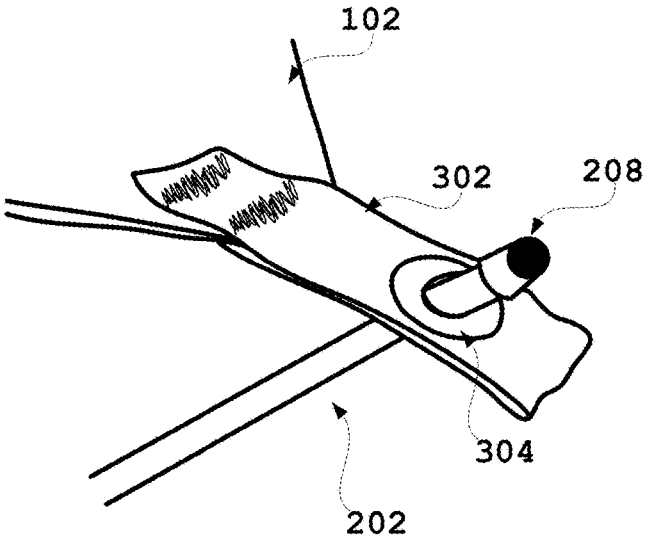

FIGS. 3A and 3B show exemplary representations of the connecting assembly, in accordance with an embodiment of the present disclosure. The connecting assembly is provisioned at corners of the collapsible plane 102, for establishing a connection between the corners of the collapsible plane 102 and the second end of the plurality of legs of the detachable frame structure 104. In an embodiment, the number of the plurality of legs is equal to the number of corners of the collapsible plane 102. For example, in the illustrated example, since the collapsible plane 102 is trapezoidal with four corners, four legs are required to hold the collapsible plane above the surface. In an embodiment, the connecting assembly at each corner from the corners comprises a first looped ribbon 302 attached on the collapsible plane 102 at the corner as shown in FIG. 3A. The first looped ribbon 302 may be sewn on the collapsible plane 102 at the corner. The sewing may be done to strongly attach the first looped ribbon 302 with the collapsible plane 102. In an embodiment, additional support may be stitched on the collapsible plane 102 to attach the first looped ribbon 302 with the collapsible plane 102. Further, the connecting assembly comprises a grommet 304 on the first looped ribbon 302. In an embodiment, the grommet 304 may be pressed on the first looped ribbon 302. The second end of the corresponding leg is accommodated within the grommet 304 as shown in FIG. 3B. The first looped ribbon 302 serves as a conduit for mounting the grommet 304 and a sewing location to the collapsible plane 102. In an embodiment, the detachable frame structure 104 may be detachable from the collector arrangement 110. In an embodiment, the first looped ribbon 302 may include additional material such that a user can tie the supporting cable to an external substance to support the collapsible plane 102, excluding the detachable frame structure 104. The external substance may include elastic cords, ropes, sticks, straps, and so on.

Each corner of the collapsible plane 102 may include such looped ribbon with grommets to accommodate corresponding legs of the detachable frame structure 104. One or more other connecting mechanisms, known to a person skilled in the art, may be implemented to establish a connection between the corners of the collapsible plane 102 and the plurality of legs.

Figure 4:
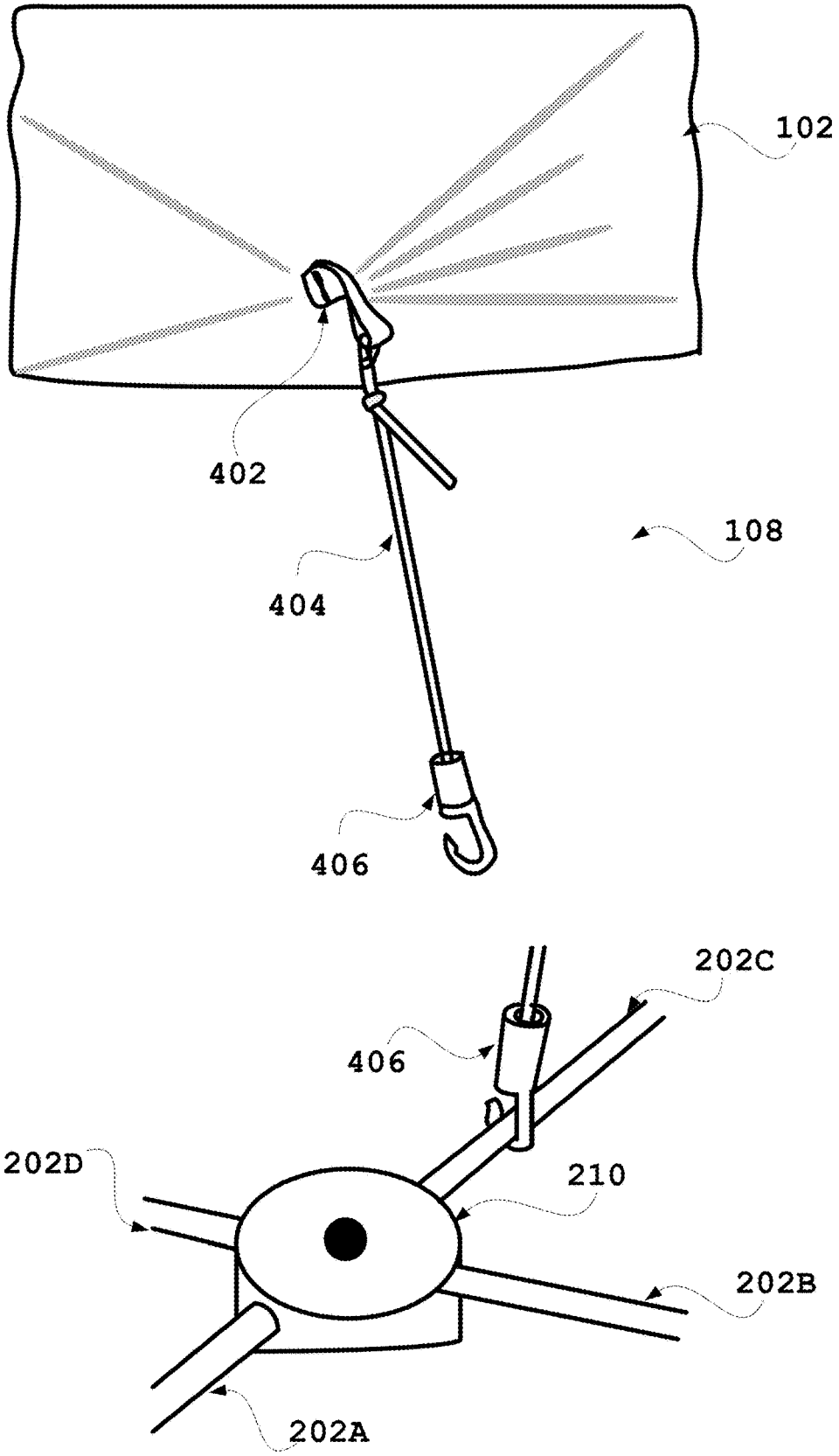
FIG. 4 shows exemplary representations of geometry defining mechanism, in accordance with an embodiment of the present disclosure.

FIG. 4 shows exemplary representations of the geometry defining mechanism 108, in accordance with an embodiment of the present disclosure. The geometry defining mechanism 108 establishes a connection between the center of the bottom side of the collapsible plane 102 with the detachable frame structure 104. The geometry defining mechanism 108 defines a geometry of the collapsible plane 102. The geometry may be defined such that the substance collection on the first end of the collapsible plane 102 moves towards a container accommodated in the collecting unit 100. The geometry defining mechanism 108 comprises a second looped ribbon 402 attached at the center of the bottom side of the collapsible plane 102. In an embodiment, the second looped ribbon 402 may be sewn to the bottom side of the collapsible plane 102. Further, the geometry defining mechanism 108 includes a pulling cord 404, where a first cord end of the pulling cord 404 is attached to the second looped ribbon 402, and a second cord end of the pulling cord 404 is attached to the detachable frame structure 104. In an embodiment, the second cord end of the pulling cord 404 is coupled with a hooking component 406 to hook with one of the plurality of legs 202A, 202B, 202C, and 202D of the detachable frame structure 104 and shown in FIG. 4. In an embodiment, the first cord end of the pulling cord 404 may be tied to the second looped ribbon 402. In an embodiment, by changing the position of coupling of the hooking component 406 with a leg, the geometry of the collapsible plane 102 may be changed as desired by the user. Optimal geometry of the collapsible plane 102 may be obtained by changing the location of the hooking component 406. The optimal geometry is the shape of the collapsible plane 102 that aids in the movement of the collected substance towards the second edge of the collapsible plane 102. One or more other mechanisms, known to a person skilled in the art, may be implemented to achieve the geometry change of the collapsible plane 102.

Figure 5A:
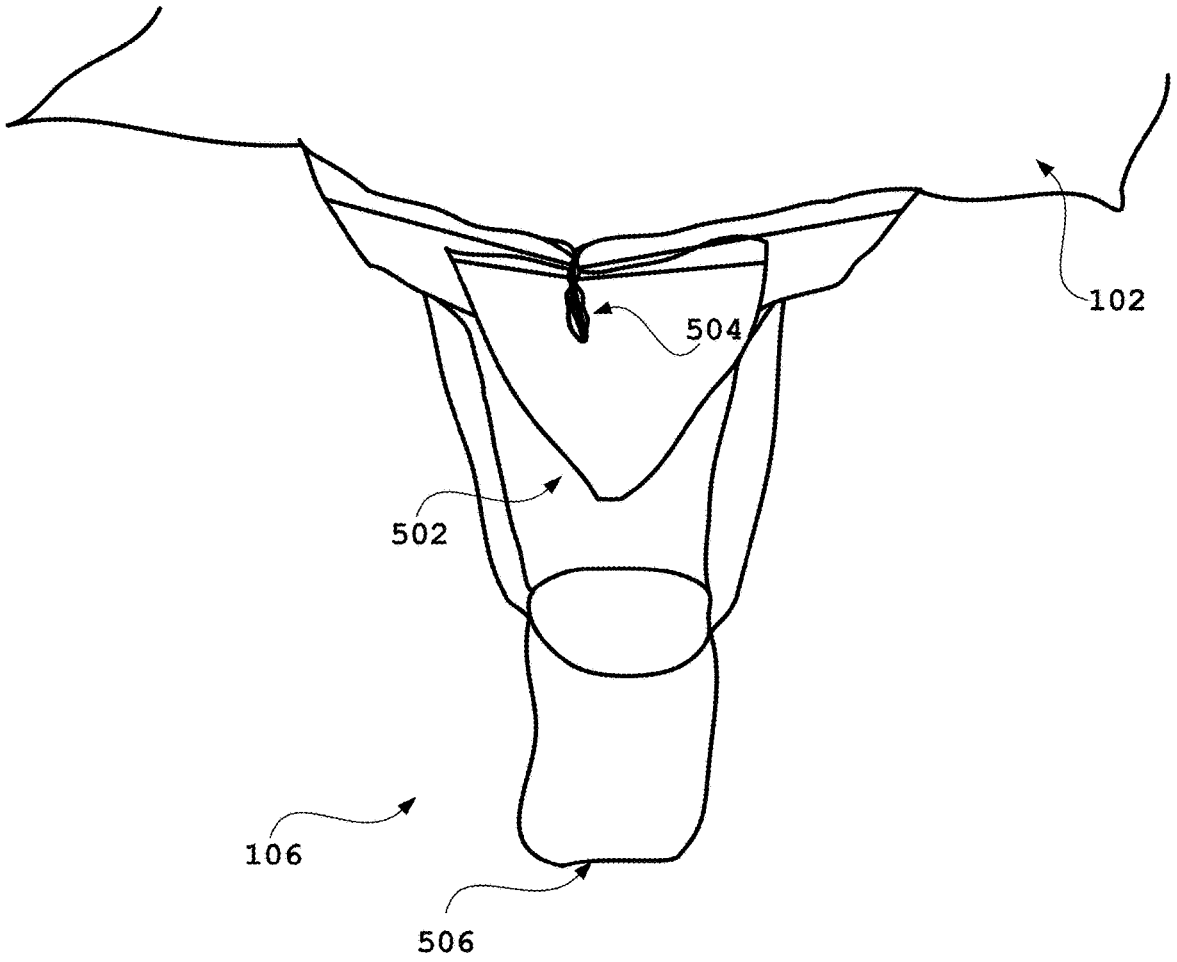
FIGS. 5A and 5B show exemplary representations of substance collecting and container holding mechanism, in accordance with an embodiment of the present disclosure.
Figure 5B:
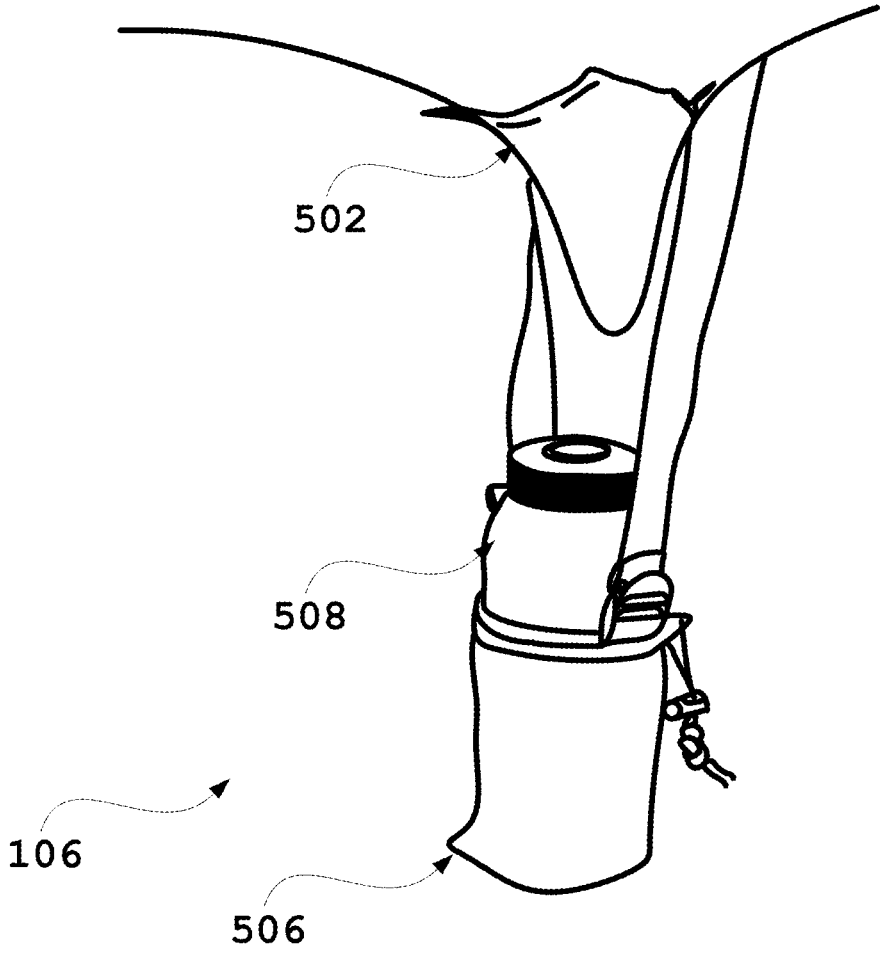
Figure 6A:
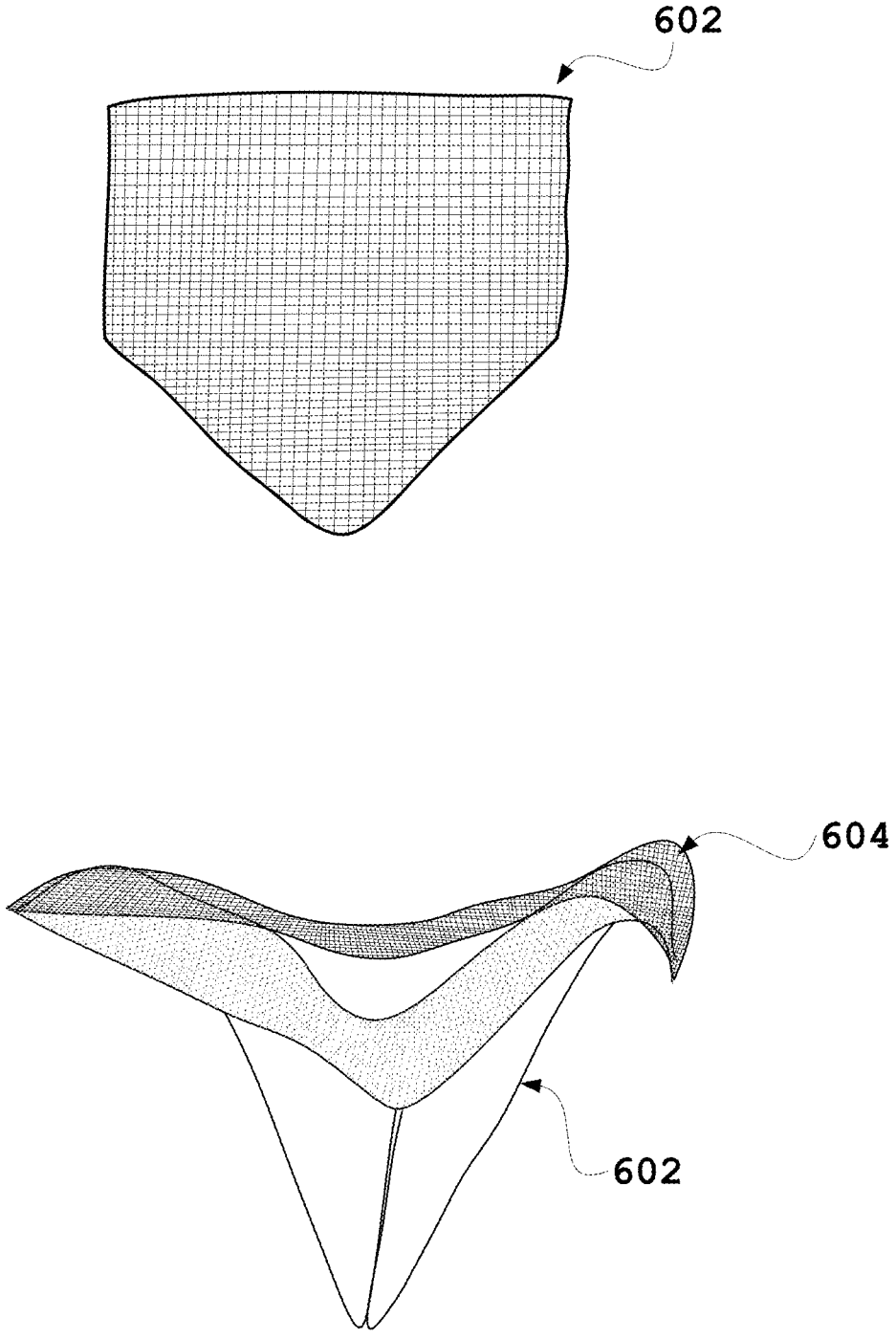
FIG. 6A shows an exemplary representation of funnel structure of substance collecting and container holding mechanism, in accordance with an embodiment of the present disclosure.
Figure 6B:
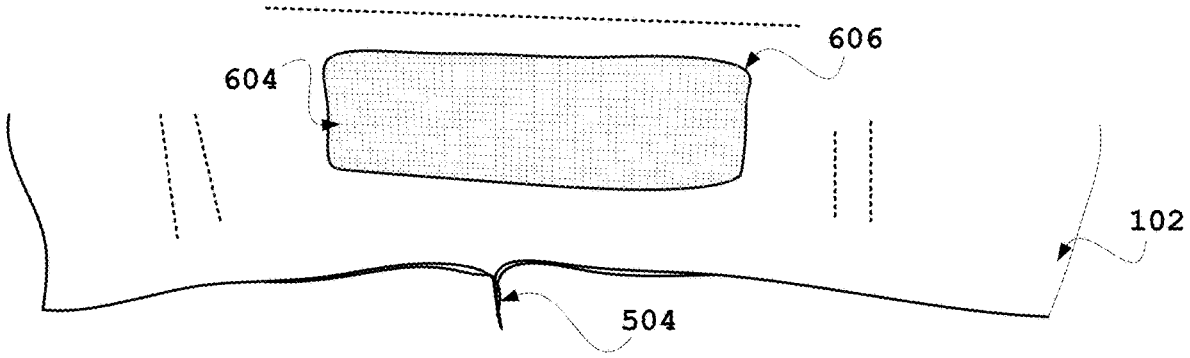
FIG. 6B shows an exemplary representation of egress and control stitch of substance collecting and container holding mechanism, in accordance with an embodiment of the present disclosure.

FIGS. 5A and 5B show exemplary representations of substance collecting and container holding mechanism 106, in accordance with an embodiment of the present disclosure. FIG. 5A shows the front view of the substance collecting and container holding mechanism 106 attached to the collapsible plane 102. The substance collecting and container holding mechanism 106 is configured to accommodate container 508 and collect the substance in container 508. FIG. 5B shows the substance collecting and container holding mechanism 106 holding the container 508. In an embodiment, the substance collecting and container holding mechanism 106 may include an egress 606 and a control stitch 504. FIG. 6B shows an exemplary representation of the egress 606 and the control stitch 504 of substance collecting and container holding mechanism 106, in accordance with an embodiment of the present disclosure. The egress 606 may be formed on the top surface towards the second edge. Egress 606 is used to channelize the collected substance towards the first edge to collect the substance. In an embodiment, the egress 606 may be cut in the fabric of the collapsible plane 102 to allow the substance to move for collection.

The control stitch 504 on the second edge is used to control the movement of the collected substance. The control stitch 504 is added to the funnel flow area after the egress 606 is cut. This changes the geometry of the funnel flow area to promote movement of the substance to pool on the end of the collapsible plane 102. A high volume of a substance may fall off or overflow the egress 606 and run off at the end of the collapsible plane 102. The control stitch 504 prevents a high volume of substance from falloff or overflowing from the end of the collapsible plane 102.

In an embodiment, the substance collecting and container holding mechanism 106 comprises further comprises a container pouch 506. The container pouch 506 accommodates the container 508 designed and placed to collect the substance. In an embodiment, the container pouch 506 may include a locking mechanism to hold the container within the container pouch 506. In an embodiment, the container pouch 506 may be made of fabric, cord, ribbon, plastic cord, and ladder locks. The ribbon and plastic cord locks connect the fabric assembly to the collapsible plane 102. The container pouch 506 fits container 508 with a diameter of normal outdoor use. The container pouch 506 may include a cord sewn into an overlapping fold on the top of the container pouch 506. This allows container 508 to be placed inside container pouch 506. Once the cord is tightened and secured with the plastic cord lock, container 508 may be securely fastened in the container pouch 506. In a non-limiting embodiment, the substance collecting and container holding mechanism 106 may exclude the container pouch and the container may be placed nearer to the first edge to collect the substance. Such embodiment may be implemented when the collecting unit 100 is larger.

In an embodiment, the substance collecting and container holding mechanism 106 may include a funnel structure 502. The funnel structure 502 may be designed to channelize the collected substance from the first edge towards container 508. FIG. 6A shows exemplary representations of the funnel structure 502 of the substance collecting and container holding mechanism 106, in accordance with an embodiment of the present disclosure. In an embodiment, when the collected substance is liquid, the funnel structure 502 includes a fabric mesh 602 and a wire mesh 604. The fabric mesh 602 may be in a cone shape, with the vertex side of the fabric mesh 602 facing the container 508 and the base side of the fabric mesh 602 attached to the second edge. In an embodiment, the fabric mesh 602 is shaped such that a designed flow path is provided to the collected substance. The wire mesh 604 may be placed on the base side of the fabric mesh 602. In an embodiment, both the fabric mesh 602 and the wire mesh 604 filters the collected liquid flowing towards container 508. In an embodiment, the fabric mesh 602 and the wire mesh 604 are sewn together and further sewn with the collapsible plane 102. In an alternate embodiment, each of the fabric mesh 602 and the wire mesh 604 is individually sewn with the collapsible plane 102.

In an embodiment, the funnel structure 502 may be located beneath the egress 606, such that substance that egresses off the collapsible plane 102 moves through the funnel structure 502. This location may be on the center long axis and lowest end of the collapsible plane 102. This location serves to collect the substance from the first side of the collapsible plane 102 and provides a means to control the movement of the substance towards container 508.

In an alternate embodiment, the collecting and container holding mechanism 106 may include funnels and tubes. A user could put a funnel in the container pouch 506 and connect a tube to connect to an external container.

In an embodiment, dimensions of components of the collecting unit 100 may be scaled to be larger or smaller based on the requirements. In an embodiment, the collapsible plane may be of a larger dimension, and a number of the straight poles of the detachable frame structure 104 may be increased to hold the collapsible plane. In an embodiment, the length of the straight poles may be increased or the number of straight poles may be increased, to hold the collapsible plane at a greater height. For example, consider rainwater is to be collected in a bottle for drinking purposes, the collecting unit 100 may be scaled to be placed in an open space and to accommodate the bottle. The collecting unit 100 is to be also used as shelter in open space. In such cases, the collecting unit 100 may be scaled to be larger such that multiple people can seek shelter under the collapsible plane. In an embodiment, the collecting unit 100 may be scaled based on the size of the container.

Figure 7:
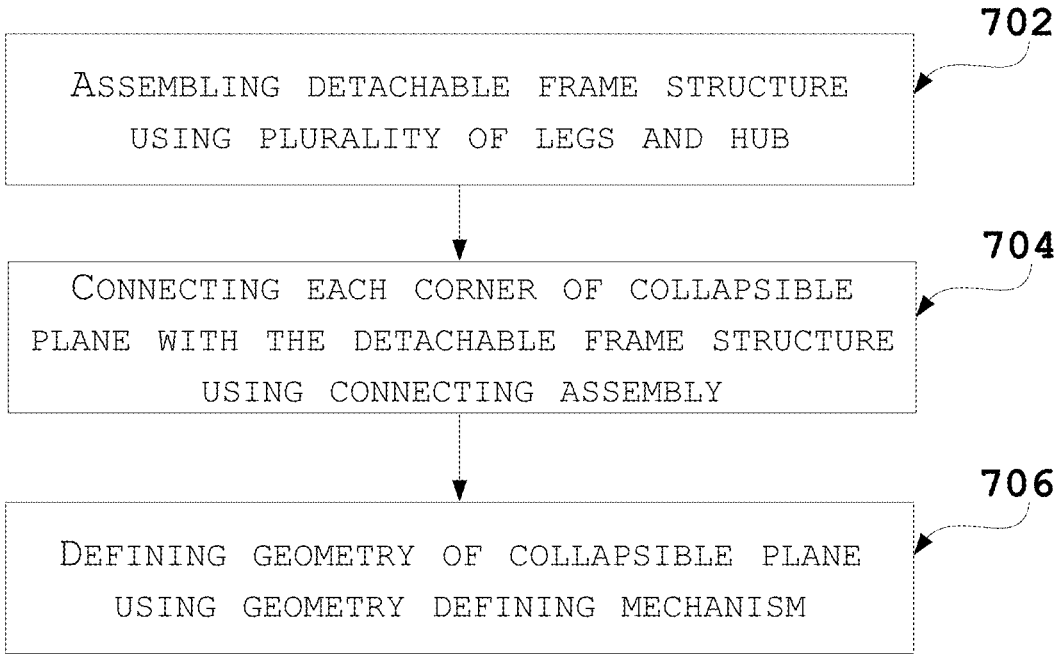
FIG. 7 shows a method for assembling the collecting unit for collecting substance, in accordance with an embodiment of the present disclosure.

FIG. 7 shows a method for assembling a collecting unit, in accordance with an embodiment of the present disclosure. The method comprises, as shown at block 702, assembling a detachable frame structure of the collecting unit using a plurality of legs and a hub having a plurality of holes on the surface of the hub. The first end of each of said plurality of legs is inserted in one hole of the plurality of holes. At-least two legs of the plurality of legs are lesser in length as compared to other legs of the plurality of legs. Further, at block 704, the method comprises connecting each corner of a collapsible plane of the collector arrangement 110 with the detachable frame structure using a connecting assembly attached to each corner of the collapsible plane. The connecting assembly is used to establish a connection between each corner of the collapsible plane and the second end of each of the plurality of legs. At block 706, the method comprises defining the geometry of the collapsible plane using a geometry defining mechanism of the collector arrangement 110 having the first side of the collapsible plane for collecting the substance and the second side facing the hub, by establishing a connection between center of the second side of the collapsible plane with the detachable frame structure, for collecting the substance.

While embodiments of the present invention have been illustrated and described, it will be clear that the invention is not limited to these embodiments only. Numerous modifications, changes, variations, substitutions, and equivalents, will be apparent to those skilled in the art without departing from the spirit and scope of the invention, as described in the claims.

Thus, it will be appreciated by those of ordinary skill in the art that the diagrams, schematics, illustrations, and the like represent conceptual views or processes illustrating systems and methods embodying this invention. The functions of the various elements shown in the figures may be provided through the use of dedicated hardware as well as hardware capable of executing associated software. Similarly, any stitches shown in the figures are conceptual only. Their function may be carried out through the operation of program logic, through dedicated logic, through the interaction of program control and dedicated logic, or even manually, the particular technique being selectable by the entity implementing this invention. Those of ordinary skill in the art further understand that the exemplary hardware, software, processes, methods, and/or operating systems described herein are for illustrative purposes and, thus, are not intended to be limited to any particular name.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously. Within the context of this document, the terms "coupled to" and with" "coupled are also used euphemistically to mean "communicatively coupled with" over a network, where two or more devices can exchange data with each other over the network, possibly via one or more intermediary device.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While the foregoing describes various embodiments of the invention, other and further embodiments of the invention may be devised without departing from the basic scope thereof. The scope of the invention is determined by the claims that follow. The invention is not limited to the described embodiments, versions, or examples, which are included to enable a person having ordinary skill in the art to make and use the invention when combined with information and knowledge available to the person having ordinary skill in the art.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter outlined in the claims is not intended to be limited to the embodiments shown herein but is to be accorded to the widest scope consistent with the principles and novel features disclosed herein. It is contemplated that additional embodiments are within the spirit and true scope of the disclosed subject matter.

I claim:

1. A collecting unit for collecting substance, the collecting unit comprises:

a collector arrangement placed to collect substance; and a detachable frame structure, wherein the detachable frame structure comprises:

a hub having a plurality of holes on a surface;

a plurality of legs, wherein a first end of each of said plurality of legs is inserted in at least one hole from the plurality of holes, wherein at-least two legs of the plurality of legs is lesser in length as compared to other legs of the plurality of legs; and a leg cord accommodated inside each leg from the plurality of legs, wherein a first cord end of the leg cord is attached to a connector tip, and a second cord end of the leg cord is attached, within the hub, to a second cord end of a leg cord accommodated inside other leg oppositely inserted in the detachable frame structure;

wherein the collector arrangement comprises:

a collapsible plane having a first side for collecting the substance and a bottom side facing the hub;

a connecting assembly attached at each corner of the collapsible plane, for establishing connection between each corner of the collapsible plane with a second end of the plurality of legs, such that corners of a first edge of the collapsible plane is connected with the at least two legs of the plurality of legs; and a geometry defining mechanism to establish connection between a center of the bottom side with the detachable frame structure, wherein the geometry defining mechanism defines geometry of the collapsible plane.

2. The collecting unit of claim 1, wherein each leg from the plurality of legs comprises at least one of:

two or more straight poles;

an angled pole, wherein the two or more straight poles and the angled pole are connected to form the leg with the first end and the second end; and the connector tip accommodated at the second end of the leg to connect with a corner of the collapsible plane.

3. The collecting unit of claim 1, wherein the detachable frame structure further comprises:

a securing mechanism to secure the plurality of legs firmly on the surface.

4. The collecting unit of claim 1, wherein the connecting assembly, at each corner of the collapsible plane, comprises:

a first looped ribbon attached on the collapsible plane at the corner; and a grommet on the first looped ribbon, wherein the second end of the corresponding leg is accommodated within the grommet.

5. The collecting unit of claim 1, wherein the geometry defining mechanism comprises:

a second looped ribbon attached at the center of the bottom side; and a pulling cord, wherein a first cord end of the pulling cord is attached to the second looped ribbon, and a second cord end of the pulling cord is attached to the detachable frame structure.

6. The collecting unit of claim 5, wherein the second cord end of the pulling cord is coupled with a hooking component to hook with one of the plurality of legs of the detachable frame structure.

7. The collecting unit of claim 1, wherein the collector arrangement further comprises:

a substance collecting and container holding mechanism attached at the first edge of the collapsible plane, to accommodate the container and collect the substance in the container.

8. The collecting unit of claim 7, wherein the substance collecting and container holding mechanism comprises:

a control stitch on the first edge to control movement of the collected substance; and an egress, formed on a top surface towards the first edge.

9. The collecting unit as claimed in claim 8, wherein the substance collecting and container holding mechanism further comprises:

a funnel structure attached to the bottom side, beneath the egress.

10. The collecting unit of claim 9, wherein the funnel structure comprises:

a fabric mesh in a cone shape, with a vertex side of the fabric mesh facing the container and a base side of the fabric mesh attached to the first edge; and a wire mesh placed on the base side of the fabric mesh.

11. The collecting unit of claim 8, wherein the substance collecting and container holding mechanism further comprises:

a container pouch fitted at the first edge to accommodate the container, wherein the container pouch comprises a locking mechanism to hold the container within the container pouch.

12. A method for assembling a collecting unit for collecting substance, said collecting unit comprises a detachable frame structure and a collector arrangement, the method comprising:

assembling the detachable frame structure using a plurality of legs and a hub having plurality of holes on a surface, wherein a first end of each of said plurality of legs is inserted in one hole of the plurality of holes, wherein at-least two legs of the plurality of legs is lesser in length as compared to other legs of the plurality of legs, assembling the detachable frame structure further comprises:

accommodating a leg cord inside each leg from the plurality of legs such that a first cord end of the leg cord is attached to a connector tip, and a second cord end of the leg cord is attached, within the hub, to a second cord end of a leg cord accommodated inside other leg oppositely inserted in the detachable frame structure;

connecting each corner of a collapsible plane of the collector arrangement with the detachable frame structure using a connecting assembly attached to each corner of the collapsible plane, wherein the connecting assembly is used to establish connection between each corner of the collapsible plane and a second end of each of the plurality of legs such that corners of a first edge of the collapsible plane is connected with the at least two legs of the plurality of legs; and defining geometry of the collapsible plane using a geometry defining mechanism of the collector arrangement having a first side of the collapsible plane for collecting the substance and a bottom side facing the hub, by establishing connection between a center of the second side of the collapsible plane with the detachable frame structure, for collecting the substance.

13. The method of claim 12, wherein assembling the detachable frame structure further comprises:

connecting two or more straight poles, and an angled pole to form each leg, from the plurality of legs, with the first end and the second end; and connecting each leg with a connector tip accommodated at the second end of the leg to connect with a corresponding corner of the collapsible plane.

14. The method of claim 12, wherein assembling the detachable frame structure further comprises:

securing the plurality of legs firmly on the surface using a securing mechanism.

15. The method of claim 12, wherein the connecting assembly at each corner of the collapsible plane, comprises:

a first looped ribbon attached on the collapsible plane at the corner; and a grommet on the first looped ribbon, wherein the second end of the corresponding leg is accommodated within the grommet.

16. The method of claim 12, wherein the geometry defining mechanism comprises:

a second looped ribbon attached at the center of the bottom side; and a pulling cord, wherein a first cord end of the pulling cord is attached to the second looped ribbon, and a second cord end of the pulling cord is attached to the detachable frame structure, wherein the second cord end of the pulling cord is coupled with a hooking component to hook with one of the plurality of legs of the detachable frame structure.

17. The method of claim 12, the collector arrangement further comprises a substance collecting and container holding mechanism comprising:

a control stitch on the first edge to control movement of the collected substance;

an egress, formed on a top surface towards the first edge; and optionally a container pouch fitted at the first edge to accommodate the container, wherein the container pouch comprises a locking mechanism to hold the container within the container pouch.

18. The method of claim 17, wherein the substance collecting and container holding mechanism further comprises:

a funnel structure attached to the bottom side, beneath the egress, wherein the funnel structure comprises:

a fabric mesh in a cone shape, with a vertex side of the fabric mesh facing the container and a base side of the fabric mesh attached to the first edge; and a wire mesh placed on the base side of the fabric mesh.

* * * * *